US007412809B2

(12) United States Patent
Yuyama et al.

(10) Patent No.: US 7,412,809 B2
(45) Date of Patent: Aug. 19, 2008

(54) MEDICINE ENVELOPE FEEDER

(75) Inventors: Shoji Yuyama, Osaka (JP); Hirokazu Chihara, Osaka (JP); Takayuki Fujikawa, Osaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 357 days.

(21) Appl. No.: 10/501,594

(22) PCT Filed: Jan. 10, 2003

(86) PCT No.: PCT/JP03/00142

§ 371 (c)(1),
(2), (4) Date: Mar. 17, 2005

(87) PCT Pub. No.: WO03/059744

PCT Pub. Date: Jul. 24, 2003

(65) Prior Publication Data

US 2005/0161875 A1 Jul. 28, 2005

(30) Foreign Application Priority Data

Jan. 16, 2002 (JP) ..... 2002-007583
Feb. 8, 2002 (JP) ..... 2002-032703

(51) Int. Cl.
*B65B 5/10* (2006.01)
*B65B 51/14* (2006.01)
*B66C 1/44* (2006.01)

(52) U.S. Cl. ..... 53/244; 53/375.7; 53/249; 53/267; 53/284.3; 294/86.4

(58) Field of Classification Search ..... 53/67, 53/244, 247, 249, 267, 284.3, 284.7, 372.7, 53/375.7, 245, 375.5; 414/416.01; 294/86.4, 294/103.1, 102.1
See application file for complete search history.

(56) References Cited

U.S. PATENT DOCUMENTS 1,605,737 A * 11/1926 Hume ..... 24/67.7
3,653,708 A * 4/1972 Merola ..... 294/102.1

(Continued)

FOREIGN PATENT DOCUMENTS

DE 197 46 378 4/1999

(Continued)

*Primary Examiner*—Rinaldi Rada
*Assistant Examiner*—Paul Durand
(74) *Attorney, Agent, or Firm*—Wenderoth, Lind & Ponack, L.L.P.

(57) ABSTRACT

A medicine envelope feeder capable of feeding a sufficient quantity of medicine envelopes while preventing injection medicine containers from leaking out of the medicine envelopes even if the shape of a bucket is of a general type. One face of the medicine envelope (3) is supported by a support member (5), excluding a tolerance for bending starting from an upper end opening part. The other face of the medicine envelope (3) is guided by a guide part (26) of a vertically movable holding member (6), and the medicine envelope (3) is folded along the support member (5) and pressed by lowering a vertically movable pressing part (27) along the guide part (26). Since the coefficient of friction of the pressing part (27) is larger than that of the support member 5, only the medicine envelope (3) can be raised while being held between the guide part (26) and the pressing part (27) when the holding member (6) is raised.

16 Claims, 16 Drawing Sheets

U.S. PATENT DOCUMENTS

| | | | | | |
|---|---|---|---|---|---|
| 4,549,760 | A | * | 10/1985 | Minenko et al. | 294/88 |
| 4,632,444 | A | * | 12/1986 | Martinez et al. | 294/86.4 |
| 4,648,233 | A | * | 3/1987 | Holland | 53/55 |
| 4,831,693 | A | * | 5/1989 | Veith et al. | 24/530 |
| 4,852,927 | A | * | 8/1989 | Minenko et al. | 294/86.4 |
| 4,996,820 | A | * | 3/1991 | Harrison, Jr. | 53/69 |
| 5,060,455 | A | * | 10/1991 | Schmeisser | 53/448 |
| 5,172,950 | A | * | 12/1992 | Benecke | 294/86.4 |
| 5,303,531 | A | * | 4/1994 | Senaratne | 53/448 |
| 5,611,193 | A | * | 3/1997 | Farrelly | 53/475 |
| 5,771,667 | A | * | 6/1998 | McGregor et al. | 53/469 |
| 5,893,595 | A | * | 4/1999 | Corbett | 294/102.1 |
| 6,024,221 | A | | 2/2000 | Yuyama et al. | |
| 6,508,497 | B1 | * | 1/2003 | Nerger | 294/86.4 |
| 6,554,337 | B2 | * | 4/2003 | Kazerooni et al. | 294/86.4 |
| 6,691,490 | B1 | | 2/2004 | Yuyama et al. | |

FOREIGN PATENT DOCUMENTS

| | | |
|---|---|---|
| JP | 11-152113 | 6/1999 |
| JP | 2000-79908 | 3/2000 |
| JP | 2000-085707 | 3/2000 |

* cited by examiner

MEDICINE ENVELOPE FEEDER

BACKGROUND OF THE INVENTION

1. Technical Field of the Invention

The present invention relates to a medicine envelope feeder.

2. Description of the Related Art

As a conventional device for feeding medicine envelopes storing injection medicine such as injection medicine in ampules to a bucket, there has been disclosed, for example in Japanese unexamined patent application No. H11-152113, a device structured such that medicine envelopes storing injection medicine containers can be fed to storage chambers formed in a bucket via a belt conveyer that is provided in a rotatable manner.

However, in the conventional structure, each storage chamber in the bucket needs to be formed such that the medicine envelopes could be accommodated upright and easily in each storage chamber so as to prevent the injection medicine containers stored in the medicine envelopes from leaking. This significantly suppresses the quantity of medicine envelopes than can be accommodated, and necessitates the provision of a bucket whose shape is of specific type. Moreover, without the use of such a specific type of bucket, it is impossible to prevent injection medicine containers from leaking out of the medicine envelopes.

SUMMARY OF THE INVENTION

It is a primary object of the present invention to provide a medicine envelope feeder capable of feeding a sufficient quantity of medicine envelopes while preventing injection medicine containers from leaking out of the medicine envelopes even if the shape of a bucket is of a general type.

According to the present invention, as a means to solve the aforementioned problem, there is provided a medicine envelope feeder comprising:

a support member for supporting one face of a medicine envelope storing injection medicine containers excluding a tolerance for bending starting from an upper end opening part;

a vertically movable holding member composed of a guide part for guiding the other face of the medicine envelope at least in a specified range exceeding the tolerance for bending starting from the upper end opening part, and a pressing part which is vertically movable along the guide part and is lowered for folding and pressing the medicine envelope along the support member, wherein at least a coefficient of friction of the pressing part is made larger than that of the support member so that only the medicine envelope can be raised while being held between the guide part and the pressing part when the holding member is raised.

With this construction, the medicine envelope can be positioned between the guide member and the guide part of the holding member, and the tolerance for bending of the medicine envelope can be bent and pressed by the pressing part. When the holding member is raised, the support member is dropped off due to the difference in a coefficient of friction, by which the medicine envelope is fed while being held between the guide part and the pressing part.

A part of the support member held between the guide part and the pressing part of the holding member should preferably be composed of a rotating piece that is rotatable about one end part.

According to this construction, the rotating piece gradually rotates as the holding member is raised, so that the friction force of the support member exerted on the medicine envelope is gradually reduced. This enables the holding member to hold and feed the medicine envelopes smoothly.

In the medicine envelope feeder, it is preferable that the support member is provided in a rotatable manner around a lower end part and comprises medicine envelope detection means for detecting that the medicine envelope is fed, driving means for rotary-driving the support member by the medicine envelope detection mean detecting the medicine envelope, and rotating position detecting means for detecting that the support member is rotated in a state that the medicine envelope is held between the support member and the guide part of the holding member, so that the medicine envelopes storing injection medicine containers can be automatically and smoothly moved to a feeding operation by the holding member.

The holding member should preferably be capable of moving in a horizontal direction, and comprise a rotatable contact piece which is brought into contact with one surface of the medicine envelope as the holding member moves in the horizontal direction when the held medicine envelope is fed to the bucket, so that a folded part of the medicine envelope can be positioned between the medicine envelopes, which have already been fed into the bucket, and the holding member, thereby preventing the injection containers from leaking.

The holding member should preferably comprise an inclined face which is provided on a lower end part of the guide part and is gradually inclined from the pressing part toward a lower side, so that by moving the pressing part along the inclined face of the guide part, the held medicine envelope can be inclined with a folded side facing down, and thereby allowing the medicine envelopes to be securely positioned sideways and housed horizontally in the bucket.

The holding member should preferably further comprise an elastic pressing piece for pressing an upper folded side of the medicine envelope after retaining the medicine envelope on a bottom surface of the bucket by the contact piece, which makes it possible to ensure prevention of the folded part of the medicine envelope in the bucket from opening.

According to the present invention, as a means to solve the aforementioned problem, there is provided a medicine envelope feeder comprising:

a support member for supporting one face of a medicine envelope storing injection excluding a tolerance for bending starting from an upper end opening part;

a vertically movable holding member composed of a pair of nip arms which are provided in a rotatable manner and have nip rollers at respective top ends for folding a tolerance for bending of the medicine envelope by one nip roller as the holding member is horizontally moved, and for holding the medicine envelope in a twofold state by lowering the both nip rollers so as to be positioned on both sides of the support member, wherein at least a coefficient of friction of the nip rollers is made larger than that of the support member, so that only the medicine envelope can be raised while being held between the both nip rollers when the holding member is raised.

With this construction, it becomes possible to securely fold the opening part of the medicine envelope and hold and feed the medicine envelope despite of the simple constitution.

A rotating angle of the nip arms in the holding member should preferably be changeable according to conditions of the medicine envelope, which implements a smooth operation without opening the opening part when the medicine envelopes are fed and placed.

DETAILED DESCRIPTION OF THE INVENTION

Embodiments of the present invention will now be described with reference to the accompanying drawings.

First Embodiment

Figure 1:
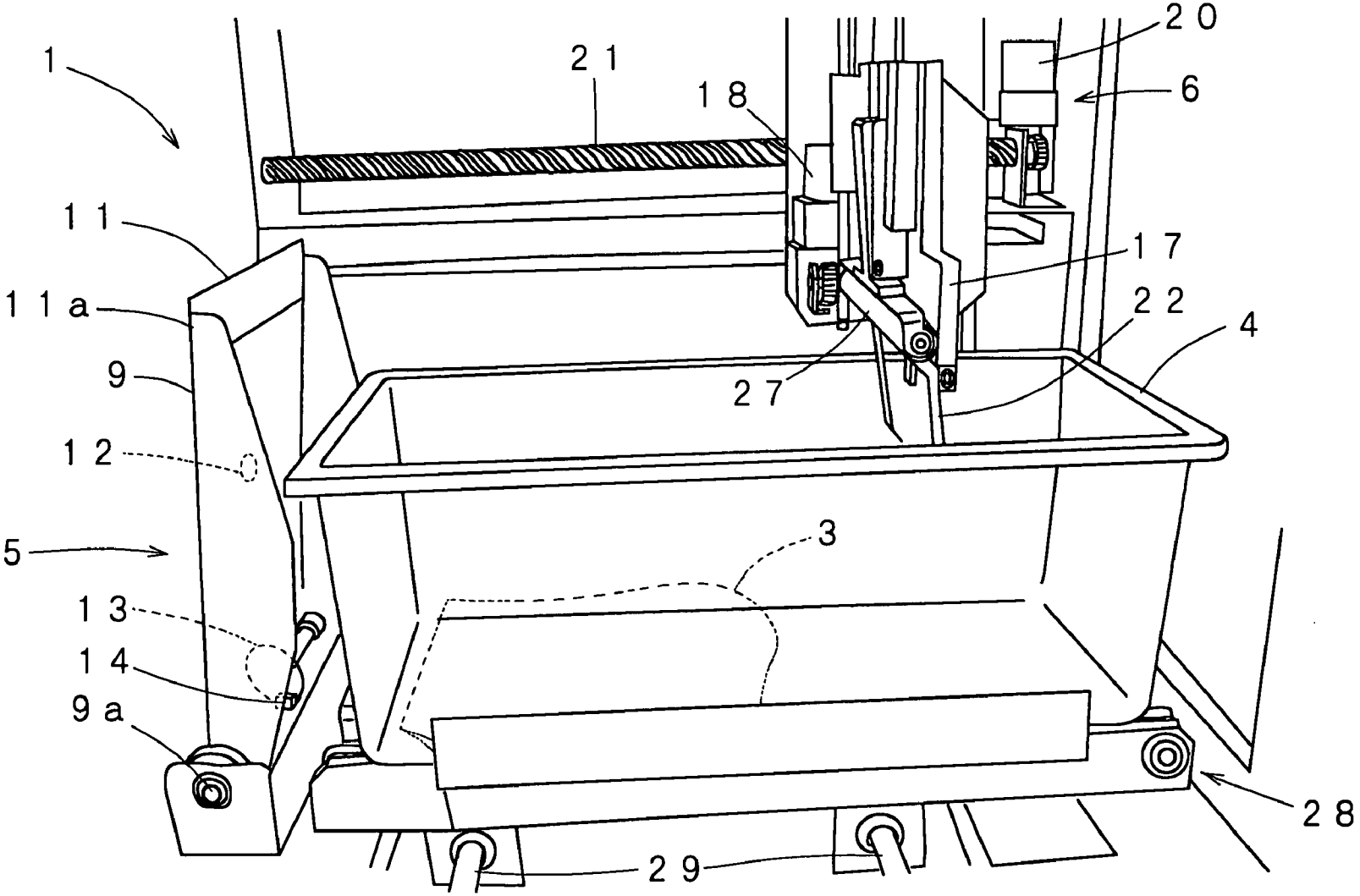
FIG. 1 is a perspective view showing a medicine envelope feeder according to the present embodiment.
Figure 3:
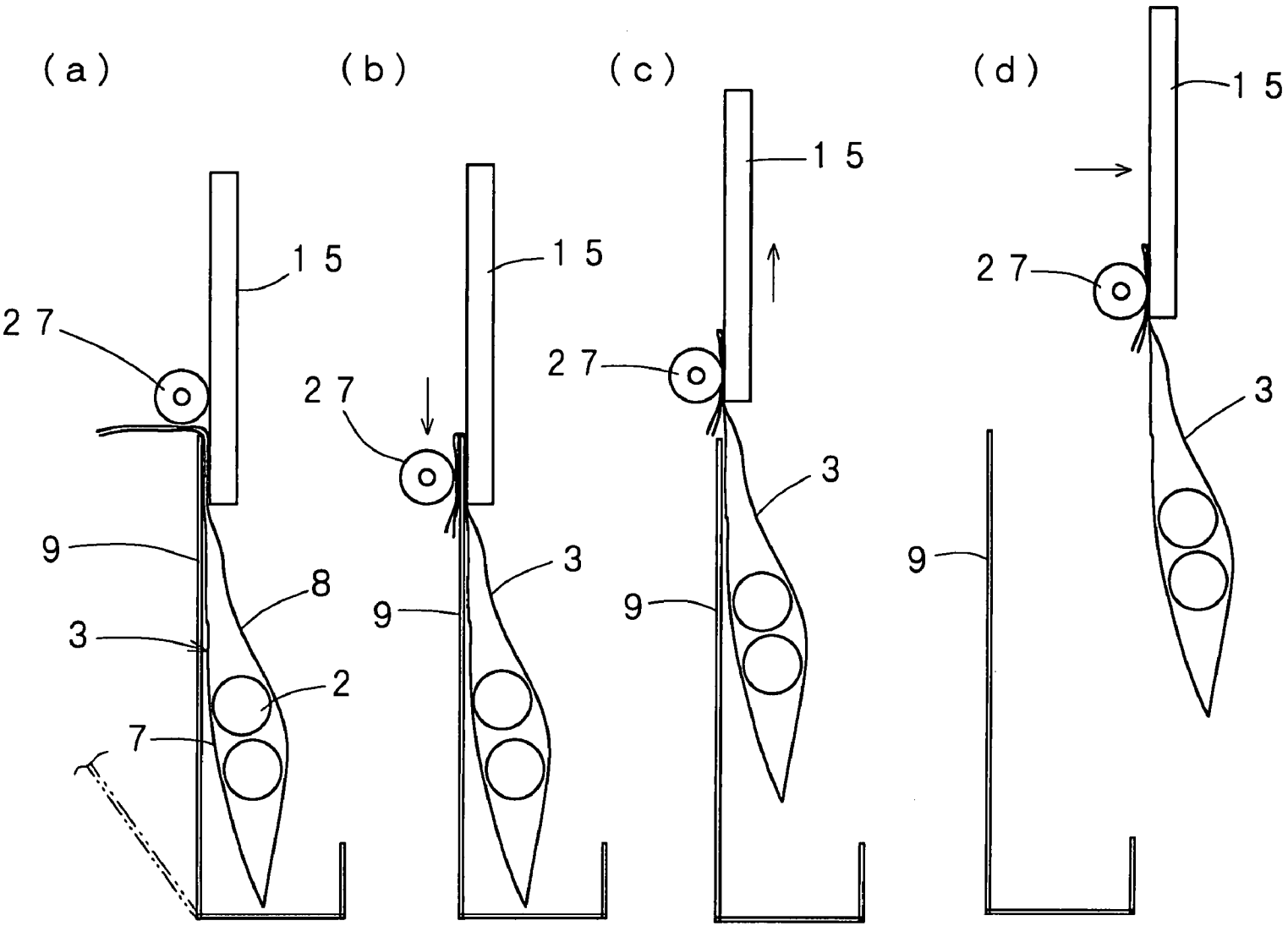
FIG. 3 is a schematic view showing a feeding operation from a support member by the holding member.

FIG. 1 shows a medicine envelope feeder according to the first embodiment. The medicine envelope feeder 1, which is for feeding medicine envelopes 3 storing injection medicine containers 2 (see FIG. 3(*a*)) such as ampules to a bucket 4 for automatic transportation, is mainly composed of a support member 5 and a holding member 6. As shown in FIG. 3, the medicine envelope 3 is of a bag type formed by attaching a resin film 8 on three sides of a paper sheet 7, i.e., both lateral sides and a lower edge side. The film 8 contains printed information on the injection medicine container 2 to be stored (e.g., drug name, quantity, etc.).

Figure 5:
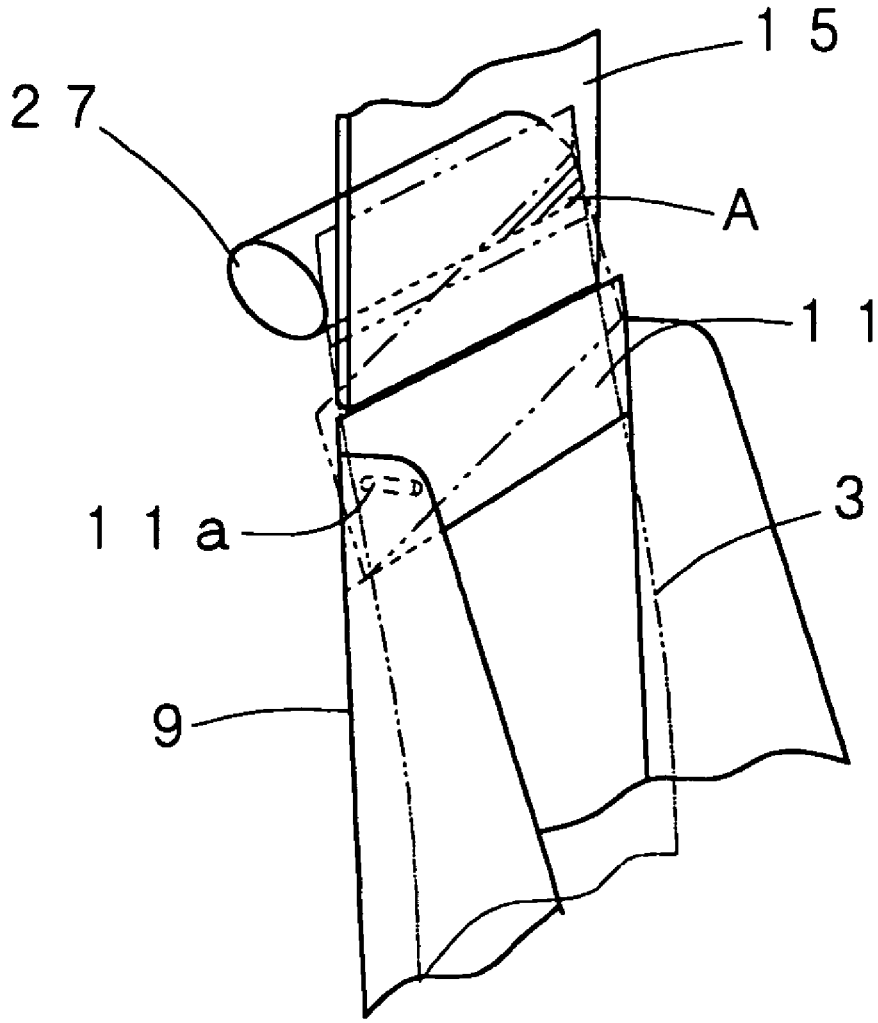
FIG. 5 is a perspective view showing the upper part of the support member.

The support member 5 is composed of a support plate 9 which is made of stainless steel or the like with both lateral sides being folded at right angles, and is mounted in a rotatable manner so as to rotate about a spindle 9*a* on the lower end by driving of a rotating motor (not shown). As shown in FIG. 5, the upper end part of the support plate 9 is composed of a rotating piece 11 rotatable about a spindle 11*a*. The height of the support plate 9 is set at a value that allows a folded part of the medicine envelope 3 to protrude from the upper edge in the state of supporting the medicine envelope 3. A medicine envelope detection sensor 12 is provided on the central part of the support plate 9 so that the presence or absence of the medicine envelope 3 to be fed can be detected. Moreover, a detection disk 13 is provided on the spindle 9*a*, so that a rotating position of the support plate 9 can be detected by the detection disk 13 in conjunction with a rotating position detection sensor 14. The support member 5 can rotate between a reception position (chain double-dashed line in FIG. 3(*a*)) of the medicine envelope 3 that is inclined at a slant angle and a delivery position (solid line in FIG. 1 and FIG. 3(*a*)) rotated in vertical direction.

Figure 2:
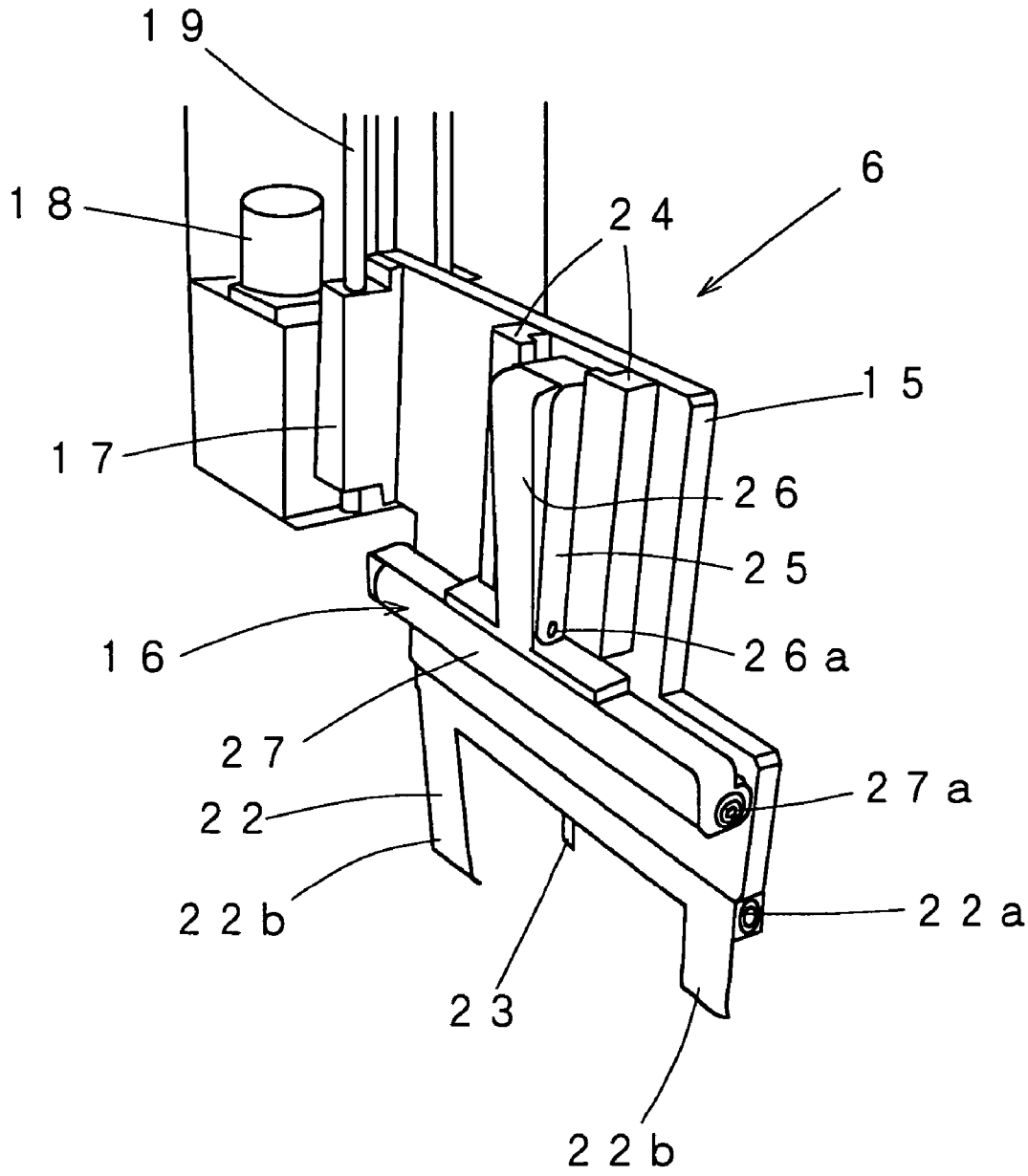
FIG. 2 is a perspective view showing a holding member of FIG. 1.

As shown in FIG. 2, the holding member 6 is composed of a guide plate 15 and a pressing arm 16 attached to the guide plate 15 in a rotatable and vertically movable manner. The guide plate 15, which is placed on a holding plate 17, can be vertically moved along a slide rail extending in vertical direction by driving of a Y-axis servomotor 18. Moreover, the holding plate 17 can be moved, as shown in FIG. 1, in a horizontal direction via a rod screw 21 by driving of an X-axis servomotor 20. Consequently, the holding member 6 can freely move in the Y-axis direction (vertical direction) and the X-axis direction (horizontal direction), i.e., to respective positions including a standby position on the upper right end, a medicine envelope reception position on the lower left side and a medicine envelope feeding position to the bucket 4 on the right side in FIG. 1. Moreover, guide blocks 24 are positioned side by side in the vertical direction on one face of the guide plate 15 at a specified interval. Further, on the lower end part of the guide plate 15, a contact piece 22 is provided rotatably about a spindle 22*a*. The contact piece 22 has a large notch on the central part so that only the side parts can come into contact with the medicine envelope 3. Moreover, on the central part of the contact piece 22, a check sensor 23 is provided so as to be able to detect whether or not the medicine envelope 3 is appropriately held. The pressing arm 16 is composed of a rod-like guide part 26 provided rotatably about a spindle 26*a*. A guide piece 25 can be vertically moved by driving a motor (not shown) while being guided by the guide blocks 24. A pressing part 27 extending in across-the-width direction is provided on the top end of the guide part 26. The pressing part 27 is formed in a cylindrical shape, and is rotatable about a spindle 27*a*. The pressing part 27 is formed in part of a material having a large coefficient of friction (at least larger than that of the support plate 9) such as silicon rubber or the like. Moreover, the pressing arm 16 is biased by a spring (not shown) or the like in such a manner that the pressing part 27 comes into pressure contact with the side of the guide plate 15.

It is to be noted that the bucket 4 can be conveyed by a conveyer device 28 as shown in FIG. 1. Further, the conveyer device 28 can move along a slide rail 29.

Figure 6:
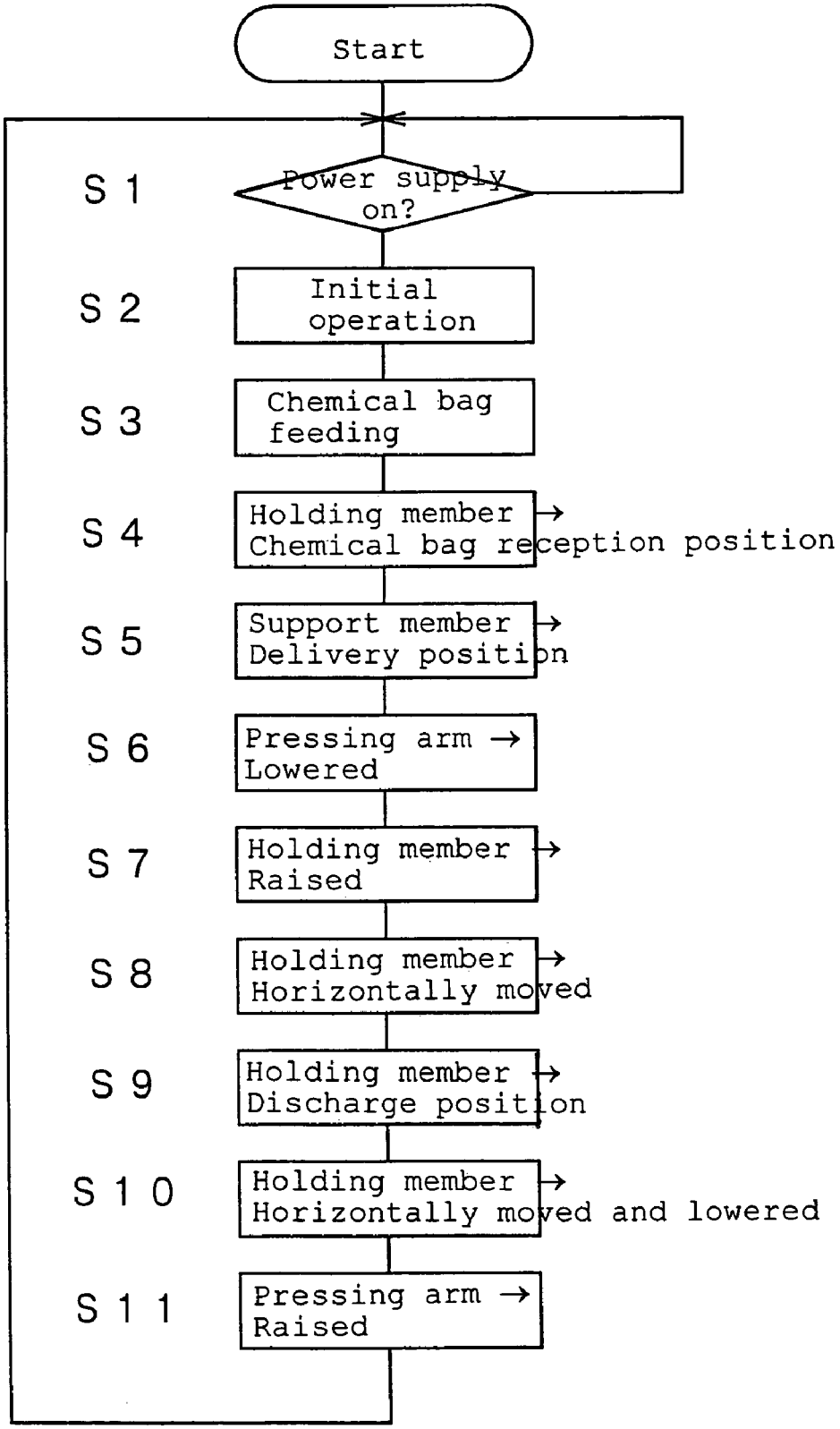
FIG. 6 is a flowchart showing feeding processing.

Next, the operation of the above-structured medicine envelope feeder 1 will be described with reference to the flowchart of FIG. 6.

Once a power supply is turned on (step S1), an initial operation is executed. The initial operation consisting of designating a home position and then sitting in a specified position (step S2) on standby. More specifically, the support member 5 is positioned at a reception position for the medicine envelope 3 (chain double-dashed line in FIG. 3(*a*)), the holding member 6 is positioned at a home position on the upper right end in FIG. 1, and the pressing arm 16 of the holding member 6 is positioned in a raised position. In this state, the medicine envelope 3 storing the injection medicine containers 2 is fed by a bagging device (not shown) to the support member 5 that is positioned at the reception position (step S3).

Then, as shown in FIG. 3, the holding member 6 is moved to the medicine envelope reception position (step S4) while the support member 5 is rotated from the reception position to the delivery position (step S5). Consequently, the medicine envelope 3 held by the support member 5 is, as shown in FIG. 3(*a*), held between the support plate 9 of the support member 5 and the guide plate 15 of the holding member 6. At this point, the lower side of the medicine envelope 3 is guided by the support plate 9, excluding a portion of the envelope for bending starting from the upper open end, and the upper portion of the envelope is guided by the guide plate 15.

After the lapse of a specified standby time (herein 1 sec.), the pressing arm 16 is lowered so that as shown in FIG. 3(*b*), the tolerance for bending of the medicine envelope 3 is folded along the support plate 9 by the pressing part 27 (step S6). Once the pressing part 27 moves to a lowermost point, the holding member 6 is raised (step S7). The friction force exerted on the medicine envelope 3 is sufficiently larger in the pressing part 27 than in the support member 5. Consequently, as shown by the double-dashed line in FIG. 3(*a*) or in detail in FIG. 5, as the holding member 6 is raised, the support member 5 gradually slips away from the medicine envelope 3 and the rotating piece 11 rotates about the spindle 11*a*. As the rotating piece 11 rotates, a contact area between the rotating piece 11 and the medicine envelope 3 is gradually decreased and so the friction force is restrained, which makes it possible to drop the support member 5 (rotating piece 11) smoothly from the medicine envelope 3. As a result, as shown in FIG. 3(*d*), the medicine envelope 3 is held between the guide plate 15 and the pressing part 27 in the state of being folded.

Figure 4:
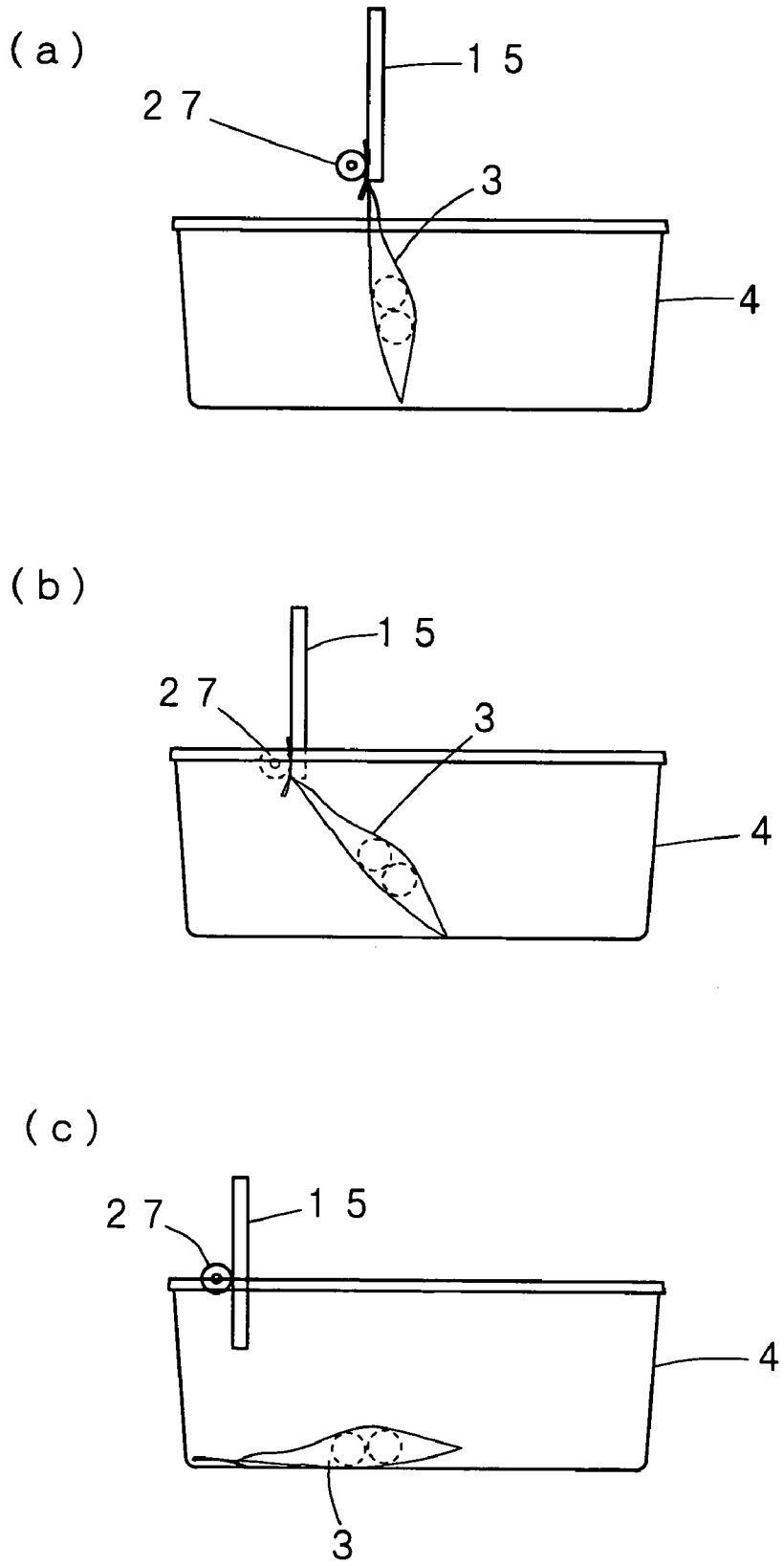
FIG. 4 is a schematic view showing the feeding state in a bucket by the holding member.

Next, the holding member 6 is moved in a horizontal direction so as to be positioned above the bucket 4 (step S8), and the medicine envelope 3 is lowered until its lower end part reaches a discharge position located in the vicinity of the bottom surface of the bucket 4 as shown in FIG. 4(*a*) (step S9). Then, as shown in FIG. 4(*b*), the holding member 6 is lowered while being gradually moved in the horizontal direction toward the support member 5 side (step S10). At this point, the contact piece 22 comes into contact with the medicine envelope 3. Consequently, the medicine envelope 3 is gradually inclined with the folded side facing down. Here, the pressing arm 16 is raised and the held state of the medicine envelope 3 by the pressing part 27 is released (step S11). Since the medicine envelope 3 is inclined as described before, the folded side is retained on the bottom surface of the bucket 4 (or the medicine envelope 3 accommodated in advance) as shown in FIG. 4(*c*), making it difficult to open the medicine envelope 3.

After that, the medicine envelope 3 is fed to the bucket 4 with the opening part being folded. Whenever the medicine envelope 3 is fed thereto, the movement position of the holding member 6 is gradually changed in conformity to preset position information. This enables the medicine envelopes 3 to be smoothly accommodated in sequence in the bucket 4 while the folded side is held without generating unnecessary spaces.

Figure 7:
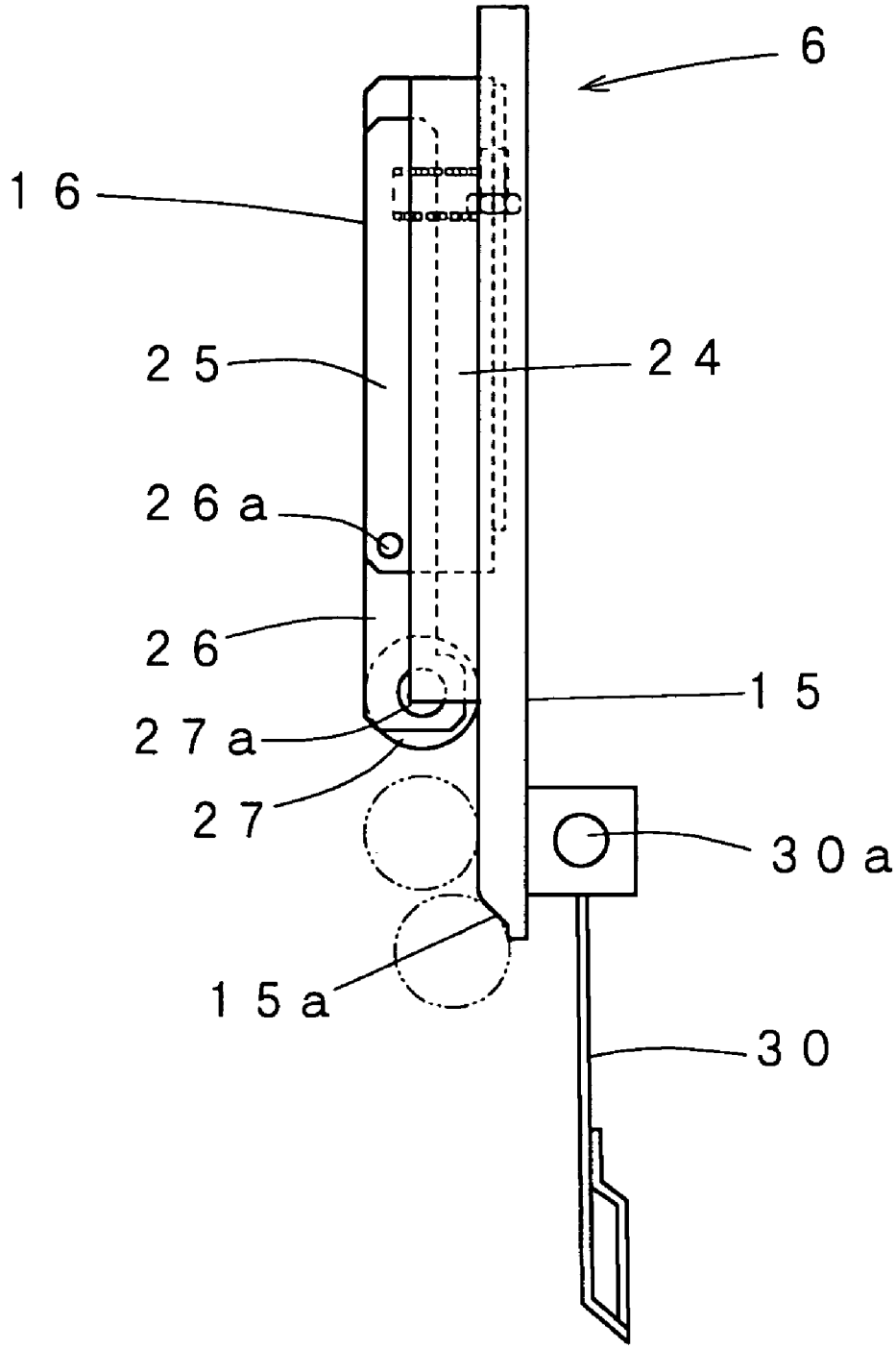
FIG. 7 is a front view showing a holding member according to another embodiment.

Although the holding member 6 is structured as shown in FIG. 2 in the aforementioned embodiment, it is also acceptable to form an inclined face 15*a* on a lower end part of the guide plate 15 and allow the pressing part 27 to move to the inclined face 15*a* as shown in FIG. 7. This makes it possible to compel the medicine envelope 3 to be inclined, thereby allowing the folded part to securely face down when the medicine envelope 3 is fed to the bucket 4. Further, without being limited to the construction in which the aforementioned side parts are provided, the contact piece 22 may be composed of a plate-like article 30 provided rotatably about a spindle 30*a*. Further, it is also acceptable to provide a sensor (not shown) for detecting a rotating position of the contact piece 22 (30). In this construction, in the case where, for example, the quantity of the injection medicine containers 2 stored in the medicine envelope 3 is large, it becomes possible to detect by the sensor that the rotating position of the contact piece 22 (30) has changed from a normal position and to correct the movement position of the holding member 6.

Further, although the upper part of the medicine envelope 3 is simply folded in the aforementioned embodiment, it is also acceptable to partially apply adhesives or the like to the medicine envelope 3, or to thermally seal the medicine envelope 3 by heating a part of the guide plate 15 so as to maintain the folded state.

Further in the aforementioned embodiment, the medicine envelopes 3 are fed in the bucket 4 starting from the left side. However, if the envelopes 3 are accommodated therein starting from the right side, the folded part of the already accommodated medicine envelope 3 can be pressed in sequence by the part of a next medicine envelope 3 in which the injection medicine containers 2 are housed, which further stabilizes the accommodation state and makes it possible to reliably prevent the injection medicine containers 2 from leaking. Moreover, if the medicine envelope 3 is accommodated in this manner, the folded side will not protrude upward, thereby allowing smooth accommodation of the medicine envelopes 3 on the second level.

Second Embodiment

Figure 8:
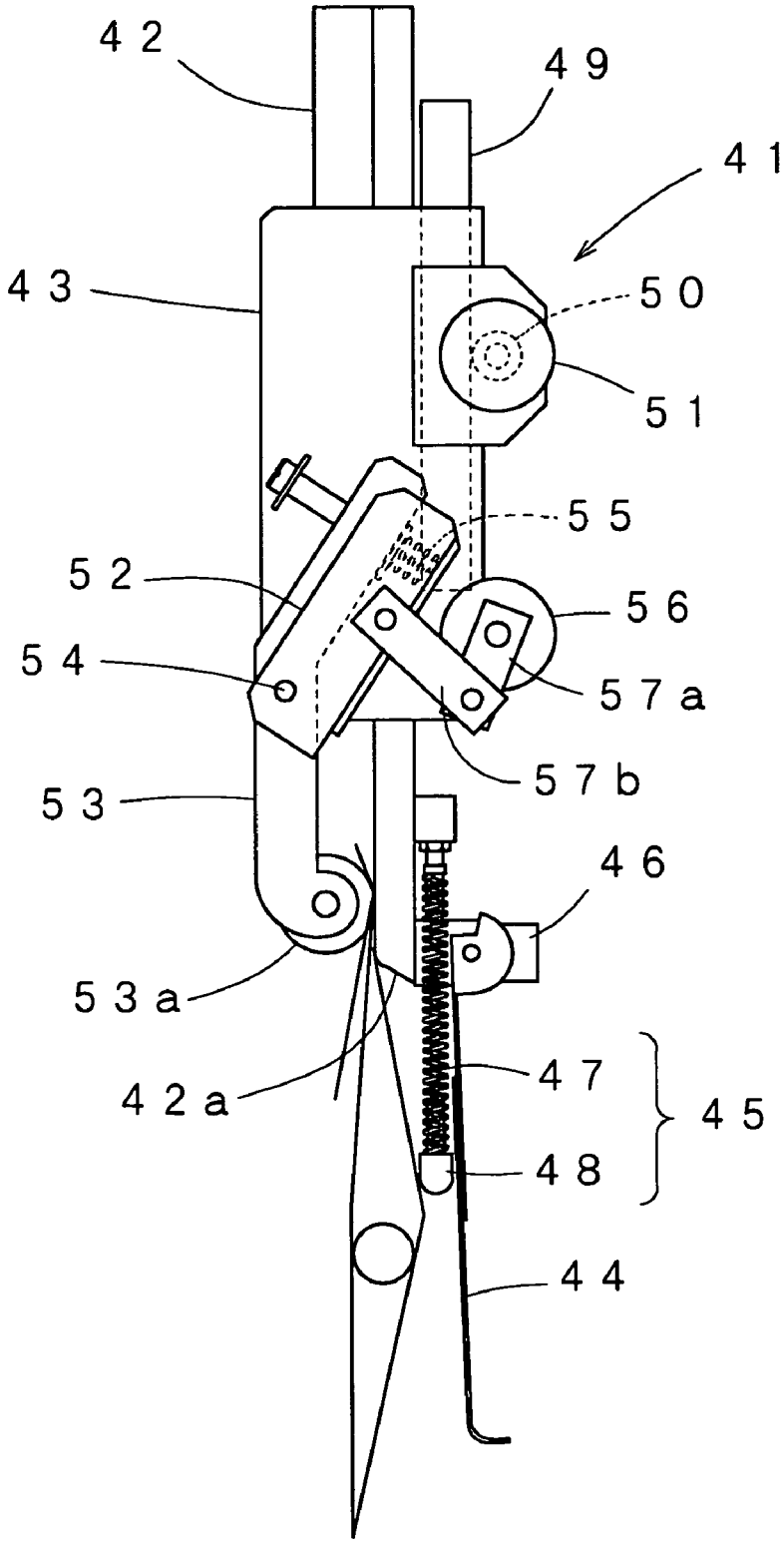
FIG. 8 is a front view showing a holding member according to another embodiment.

FIG. 8 shows a holding member 41 in a medicine envelope feeder according to the second embodiment. In this holding member 41, a holding guide 43 is provided in a vertically movable manner on a guide plate 42 which moves in the Y-axis and X-axis directions. A contact piece 44 and an elastic pressing piece 45 are provided on the lower back face of the guide plate 42. The contact piece 44 is a plate-like article provided rotatably about a spindle 44*a*, whose rotating position is detected by a sensor 46 like the contact piece shown in FIG. 7. The elastic pressing piece 45, which is formed by providing a resin protrusion 48 on the top end of a coil spring 47, has a length that is almost half of the contact piece 44. Also, the elastic pressing piece 45 protrudes downward from the guide plate 42. The head of the protrusion 48 is formed in a semispherical shape so that the medicine envelope 3 will not be damaged. Moreover, on the lower end of the guide plate 42, there is formed an inclined face 42*a* that is inclined toward a lower end of the back surface side. A holding guide 43 is vertically movable by rotary-driving a pinion 50 that is engaged with a rack 49 by a motor 51. The holding guide 43 is equipped with an arm holding part 52 and a pressing arm 53 which are provided rotatably about a spindle 54. The pressing arm 53 has an almost cylindrical pressure part 53*a* made of a silicon rubber which is rotatably provided on the top end, and is biased counterclockwise in the drawing against the arm holding part 52 by a biasing force of a spring 55. Further, the arm holding part 52 and the pressing arm 53 are rotated by driving of a motor 56 via links 57*a*, 57*b*.

It is to be noted that the pressing part 53*a* of the pressing arm 53 should preferably be formed not only in a cylindrical shape but with circular grooves over the entire circumference at specified intervals in the axial direction. According to this construction, a pressure contact force, which is generated when the medicine envelope is held by the pressing part 53*a*, will be concentrated into a part other than the circular groove, while air in the medicine envelope can be released outside, which achieves a stabilized state.

Figure 12:
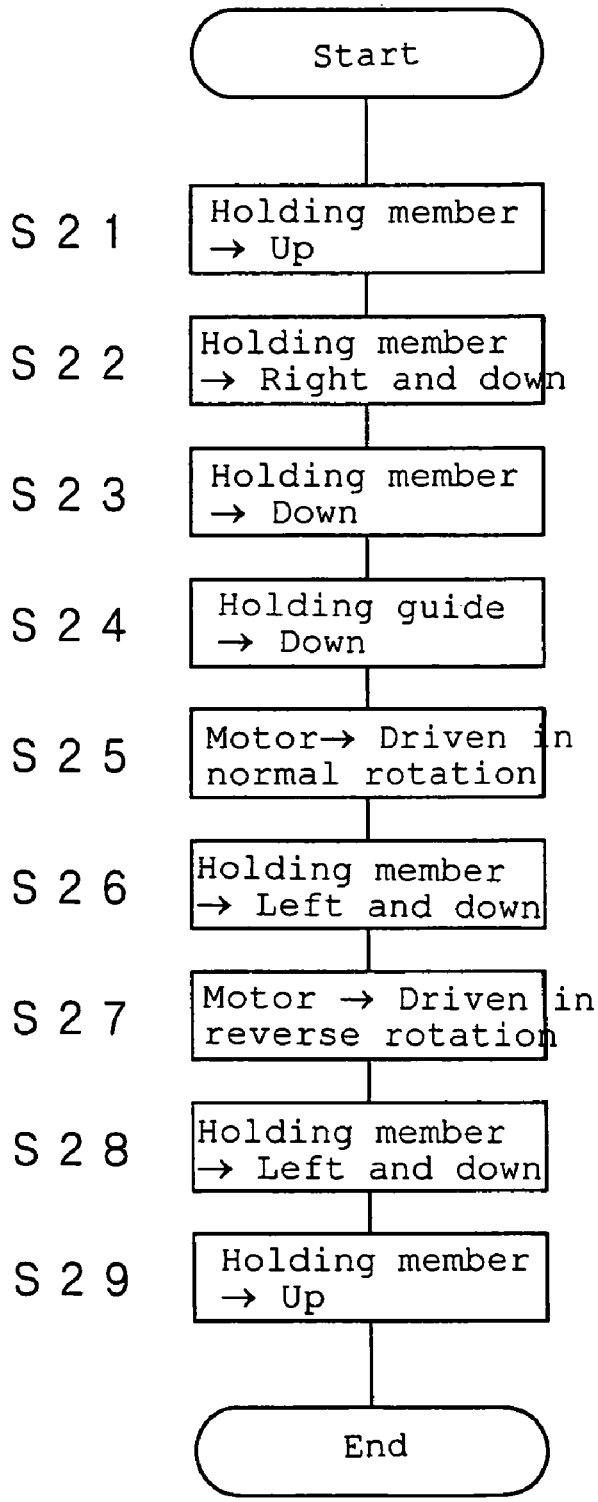
FIG. 12 is a flowchart showing feeding control by the holding member of FIG. 8.

Next, the operation of the above-structured medicine envelope feeder will be described. Since the operation until the holding member 41 receives the medicine envelope from the support member 5 is similar to that in the aforementioned first embodiment, only the operation of the holding member 41 is herein described based on the flowchart of FIG. 12.

Figure 9:
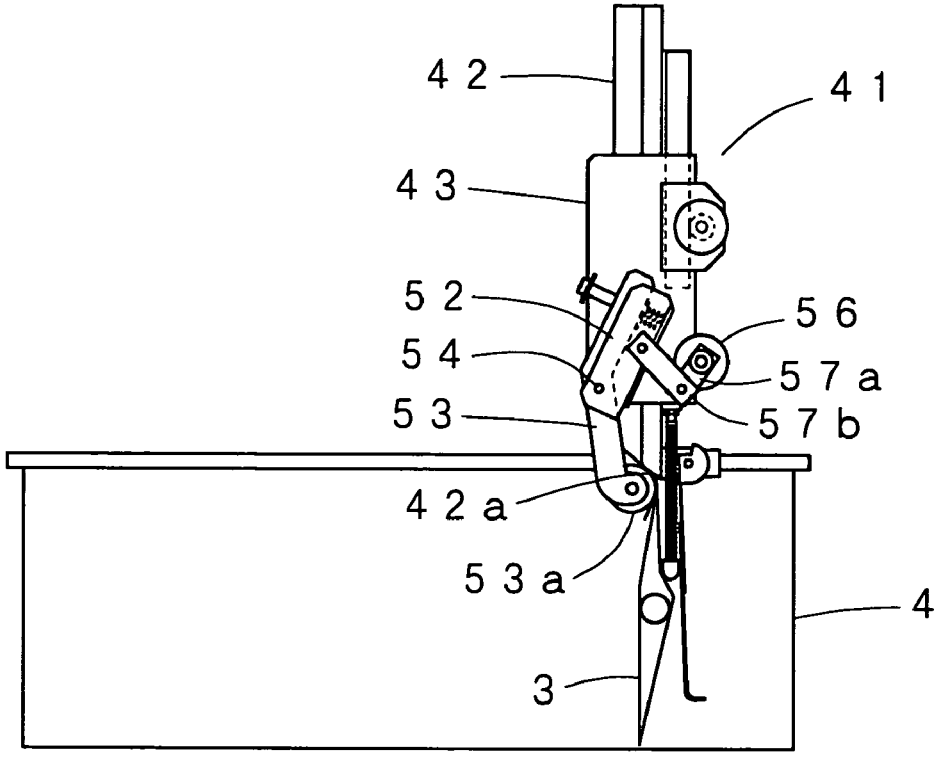
FIG. 9 is a front view showing the feeding state of the medicine envelope by the holding member of FIG. 8.
Figure 10:
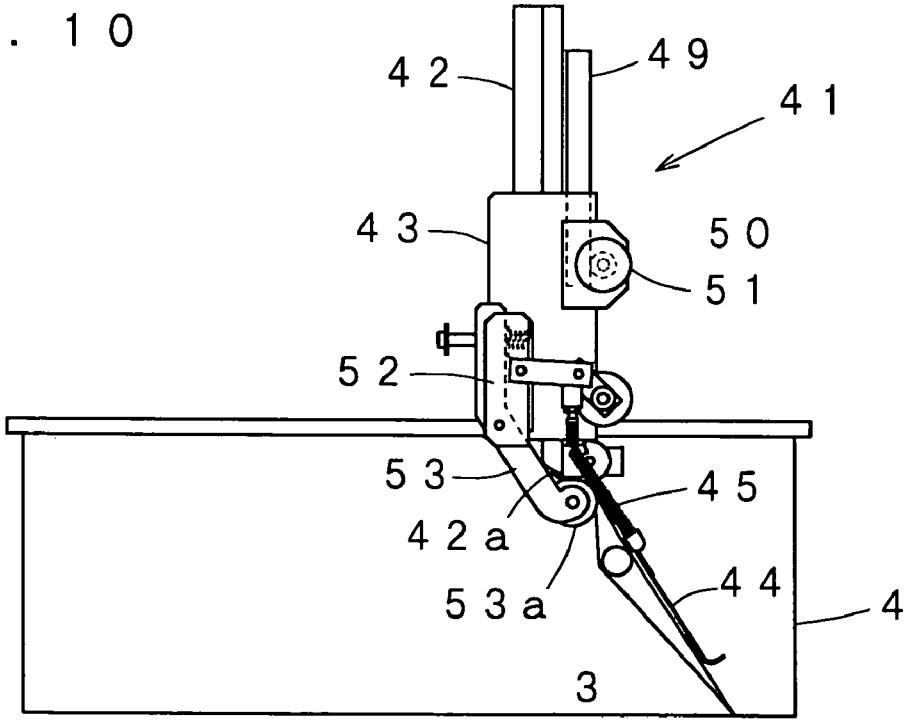
FIG. 10 is a front view showing the feeding state of the medicine envelope by the holding member of FIG. 8.
Figure 11:
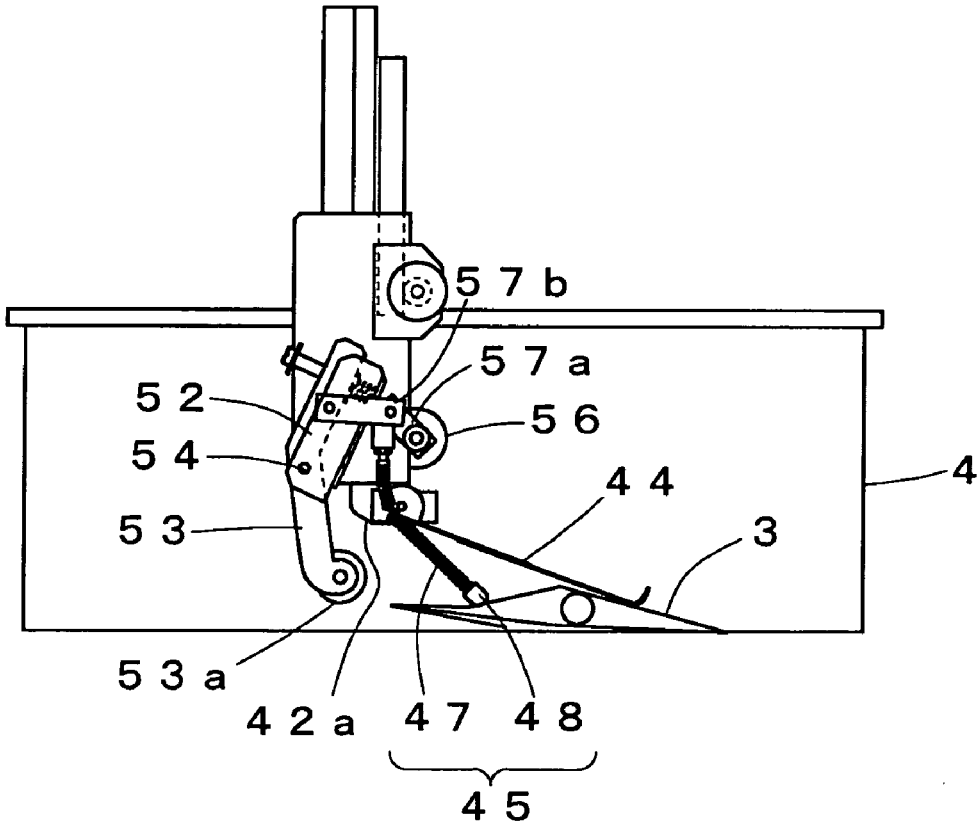
FIG. 11 is a front view showing the feeding state of the medicine envelope by the holding member of FIG. 8.

That is, the holding member 41 holding the medicine envelope is raised (step S21) and horizontally moved to the right side (step S22) before being lowered to a position shown in FIG. 9 (step S23). At this point, the holding guide 43 is lowered from the guide plate 42 (step S24), and the pressing part 53*a* is moved to an inclined face 42*a*. Then, the motor 56 is driven in normal rotation so as to rotate the arm holding part 52 and the pressing arm 53 about a spindle 54 via the links 57*a*, 57*b* (step S25), and at the same time, the holding member 41 is horizontally moved to the left side while being lowered (step S26). As a consequence, the pressing part 53*a* moves to the back face side beyond the inclined face 42*a*, ensuring the folded state of the medicine envelope 3. Moreover, the medicine envelope 3 is inclined so that the folded side is positioned on the bottom surface side as shown in FIG. 10. At this point, the motor 56 is driven in reverse rotation so as to rotate the arm holding part 52 and the pressing arm 53 clockwise about the spindle 54 via the links 57*a*, 57*b* (step S27). Further, the holding member 41 is horizontally moved to the left side while being lowered (step S28). As a consequence, the medicine envelope 3 is held in between the contact piece 44 and the bottom surface of the bucket 4, and the held state by the pressing arm 53 is released in a state such that displacement of the medicine envelope 3 is prevented. Therefore, as the holding member 41 moves, the contact position of the protrusion 48 of the elastic pressing piece 45 on the medicine envelope 3 shifts to the folded position side. As a result, as shown in FIG. 11, the medicine envelope 3 is positioned sideways while the elastic pressing piece 45 securely prevents the folded part from opening. After that, the holding member 41 is raised (step S29) in order to be ready for feeding of a next medicine envelope 3. The folded part of the medicine envelope 3 fed into the bucket 4 in this way is reliably positioned so as to face down, which prevents the stored injection medicine containers 2 from leaking during conveyance of the bucket 4 and the like.

Third Embodiment

Figure 13:
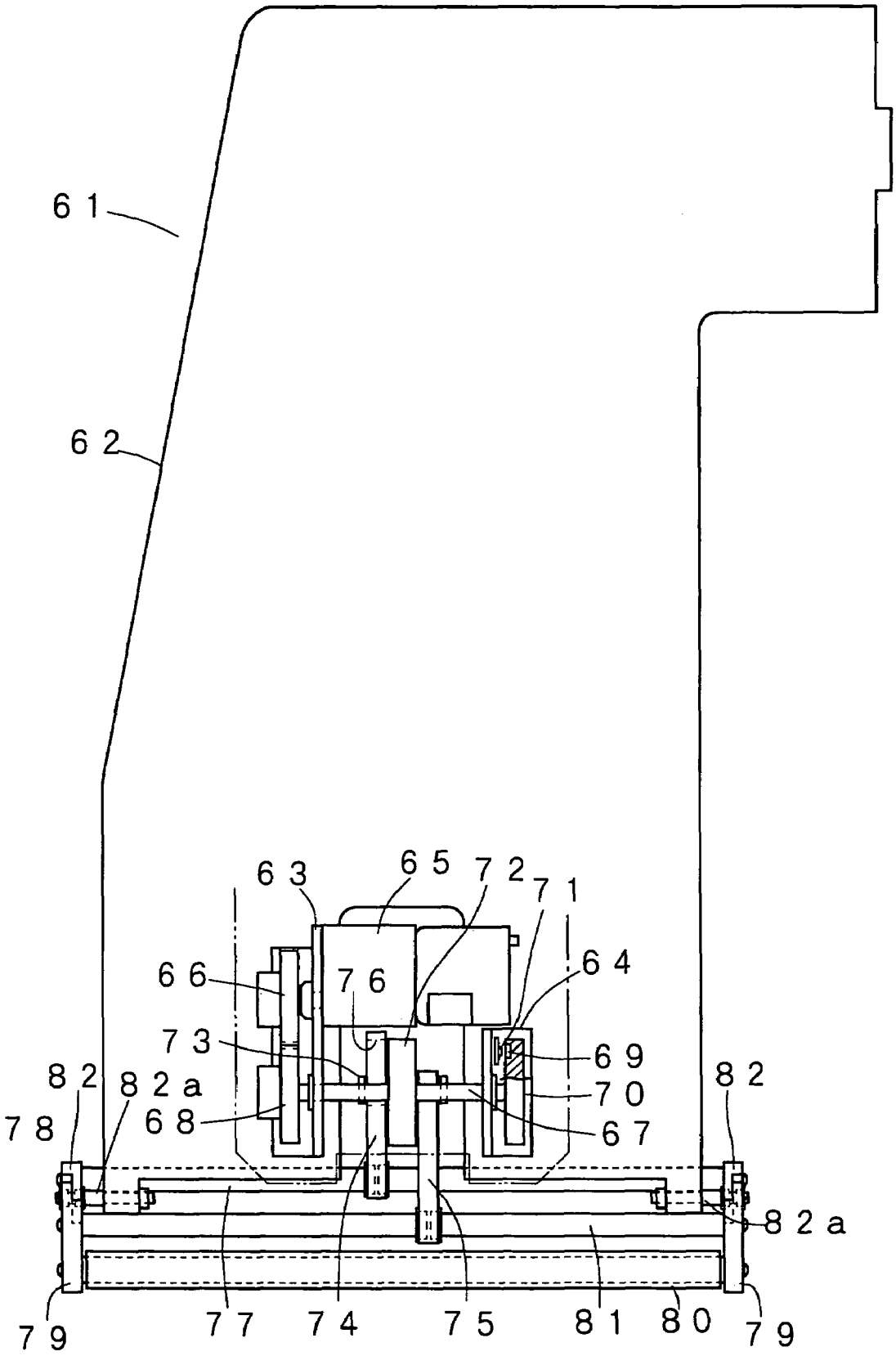
FIG. 13 is a side view showing a holding member according to still another embodiment.

FIG. 13 shows a holding member 61 of a medicine envelope feeder according to the third embodiment. The holding member 61 is provided with a guide plate 62 that moves in the X-axis and the Y-axis directions. The guide plate 62 is composed of a first support plate 63 and a second support plate 64 which are laid side by side at a specified interval. The first support plate 63 is equipped with a motor 65 that is capable of driving in both normal and reverse rotary directions, and a drive gear 66 is fixed to its rotating shaft. A shaft member 67 is rotatably supported by the support plates 63, 64.

A driven gear 68 that engages with the drive gear 66 is integrated with one end part of the shaft member 67. Moreover, a detection disk 70 having a detection part 69 made of a magnet disposed on three positions on the circumference is fixed to the other end part of the shaft member 67. The second support plate 64 is provided with a sensor 71 for detecting the detection part 69.

Further, a drive disk 72 is fixed on the central part of the shaft member 67. A guide shaft 73 is provided on an outer peripheral part of the drive disk 72, and a first arm 74 and a second arm 75 are disposed on both sides of the drive disk 72.

The first arm 74 has a long hole 76 on one end side, which is slidably connected to the guide shaft 73. A first connecting shaft 77 is provided on the other end part of the first arm 74, and a first nip arm 79 is rotatably connected to the end parts of the first connecting shaft 77 via a one-way clutch 78. With the one-way clutch 78, the first nip arm 79 can rotate clockwise in the drawing, and achieves counterclockwise rotation by following the rotation of a later-described second nip arm 82. A first nip roller 80 is rotatably provided on the top end of the first nip arm 79.

Moreover, one end part of the second arm 75 is rotatably connected to the guide axis 73, while the other end part is provided with a second connecting shaft 81. The end parts of the second connecting shaft 81 are rotatably connected to a middle part of the second nip arm 82. A spindle 82*a* on one end part of the second nip arm 82 is rotatably connected to the one end side of the first nip arm 79, and is in contact with the one-way clutch 78. Further, a second nip roller 83, which is rotatably provided on the other end part of the second nip arm 82, comes into contact with or clears away from the first nip roller 80 in a relative manner so as to hold and release the medicine envelope.

It is to be noted that the first nip roller 80 and the second nip roller 83 use elastic materials such as rubber.

Description is now given of the operation of the above-structured holding member 61.

Figure 14A:
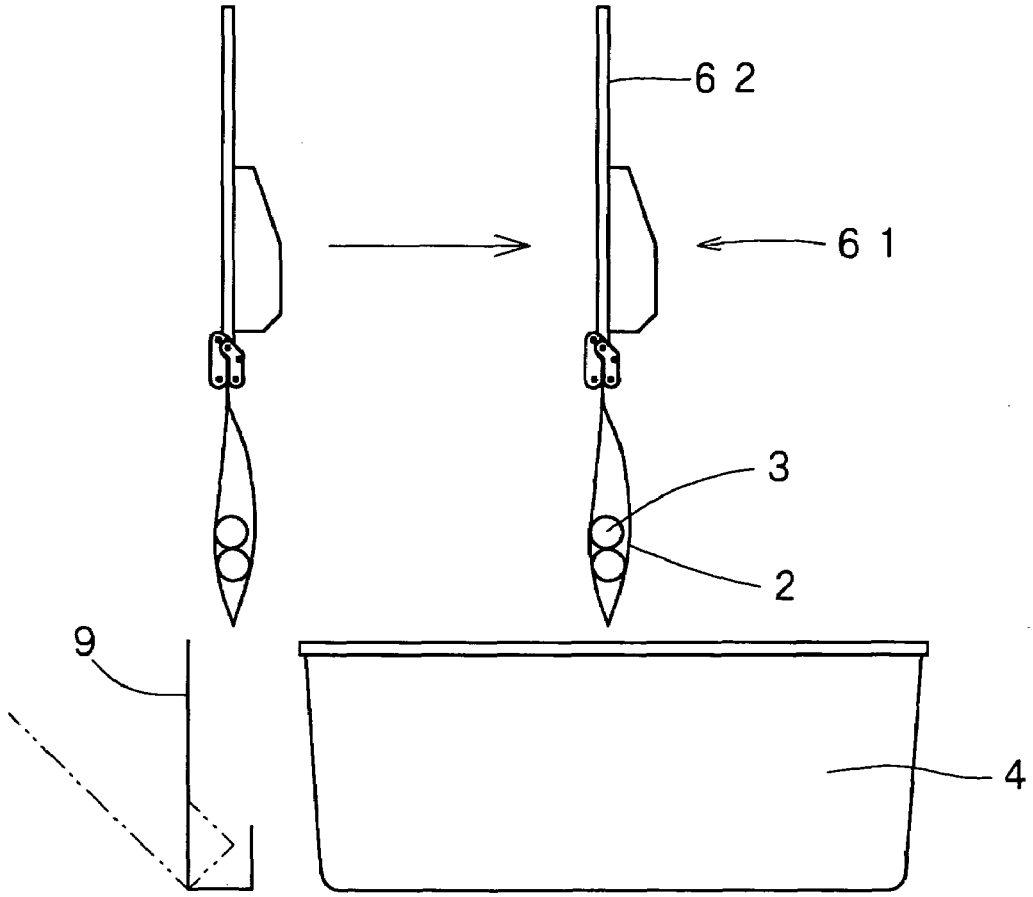
FIG. 14A is a front view showing the feeding state of the medicine envelope by the holding member of FIG. 13.
Figure 14B:
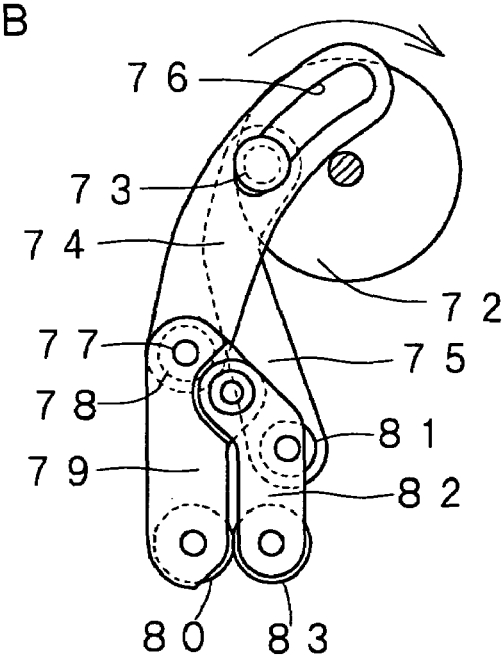
FIG. 14B is a fragmentary side view showing the state of the holding member in FIG. 14A.

First, as with the first embodiment, the holding member 61 is moved to a medicine envelope reception position. Once the medicine envelope is fed, the support plate 9 is moved from an inclined reception position to a standing delivery position. At this point, the motor 65 is driven to rotate the drive disk 72 counterclockwise so as to position the nip rollers 80 and 83 closer to each other as shown in FIG. 14. Then, the nip rollers 80, 83 are horizontally moved, and the upper part of the medicine envelope is folded along the support plate 9 before the nip rollers 80, 83 are lowered so as to be positioned on both sides of the support plate 9. As a result, the upper part of the medicine envelope is two folded. In this state, the holding member 61 is raised so that by the rotation of the rotating piece 11, the medicine envelope is lifted while being held between the nip rollers 80 and 83 as in the first embodiment.

The medicine envelope lifted from the support plate 9 is moved toward the upper side of the bucket 4 by the horizontal movement of the holding member 61. Then, as shown in FIG. 15, after the holding member 61 is lowered, the medicine envelope is moved obliquely downward.

Figure 15A:
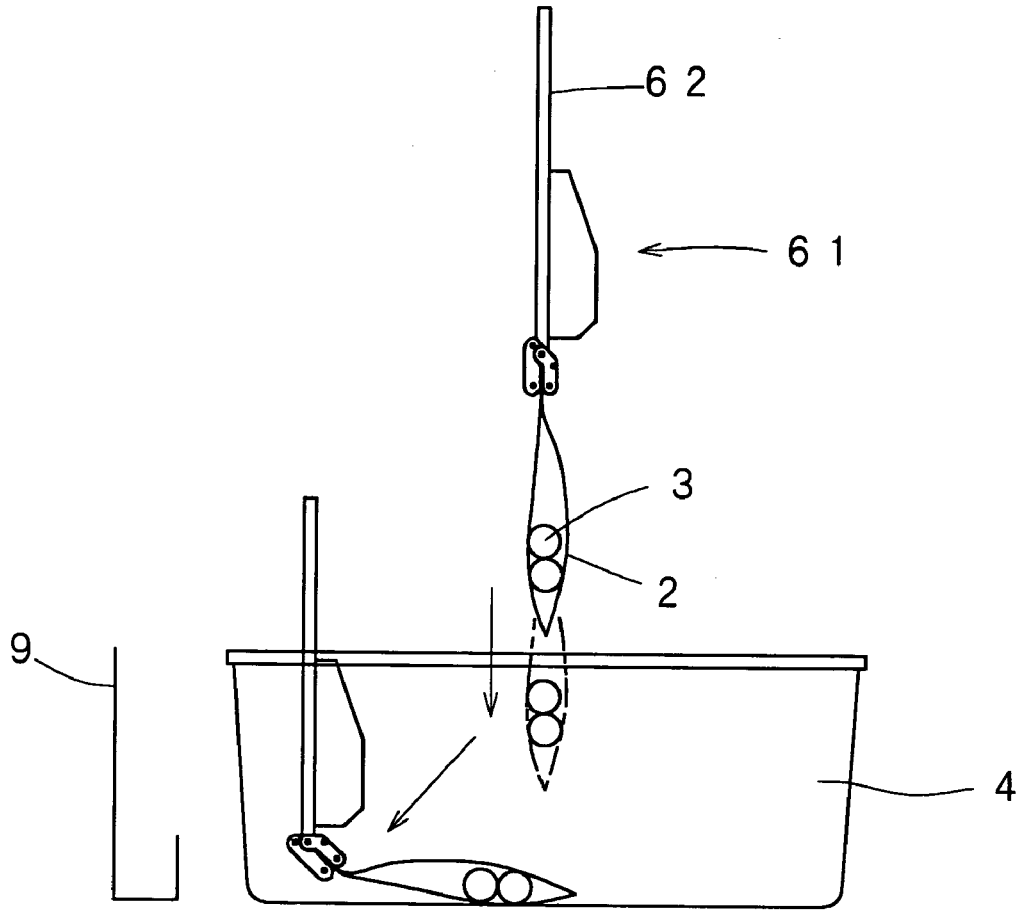
FIG. 15A is a front view showing the feeding state of the medicine envelope by the holding member of FIG. 13.
Figure 15B:
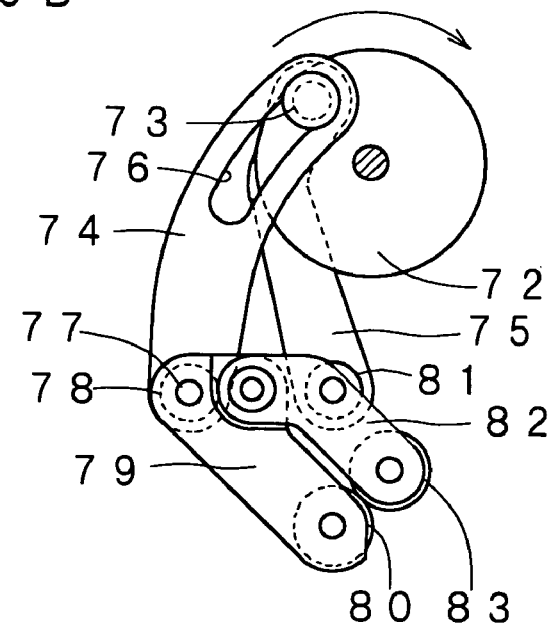
FIG. 15B is a fragmentary side view showing the state of the holding member in FIG. 15A.

When the medicine envelope is moved obliquely downward, the motor 65 is driven to rotate the drive disk 72 clockwise as shown in FIG. 15(*b*). The first arm 74 does not rotate since the guide shaft 73 simply slides along the long hole 76 and therefore an initial state is maintained. The second arm 75 moves upward with the rotation of the drive disk 72. Consequently, the second nip arm 82 uplifts the second connecting shaft 81, and rotates counterclockwise about the spindle 82*a*.

Moreover, since the spindle 82*a* is in contact with the one-way clutch 78, the first nip arm 79 rotates counterclockwise with the second nip arm 82. Therefore, the held state of the medicine envelope by the first nip roller 80 and the second nip roller 83 is maintained, and only the first nip arm 79 and the second nip arm 82 are inclined. Because of this, when the medicine envelope is placed on the bottom surface of the bucket 4, the medicine envelope can be inclined with the twofold portion being positioned on the lower side, making it possible to appropriately prevent the medicine envelope from opening.

Figure 16A:
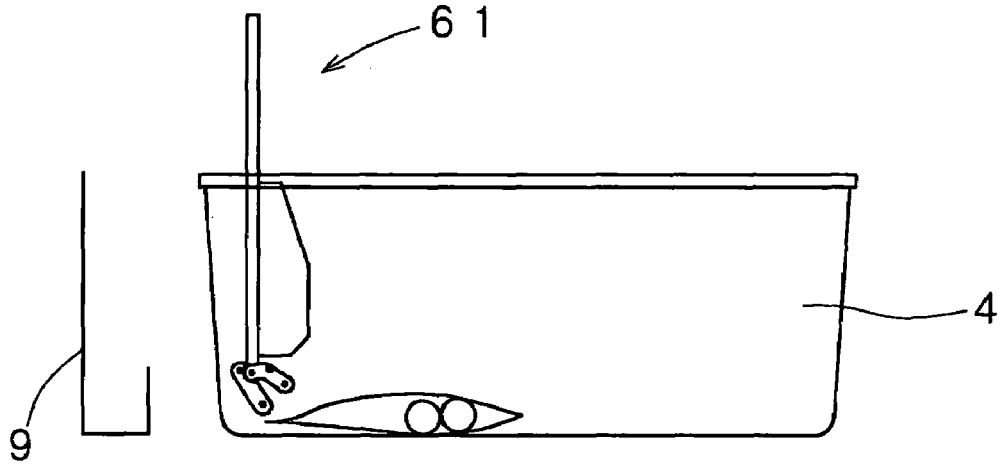
FIG. 16A is a front view showing the feeding state of the medicine envelope by the holding member of FIG. 13.
Figure 16B:
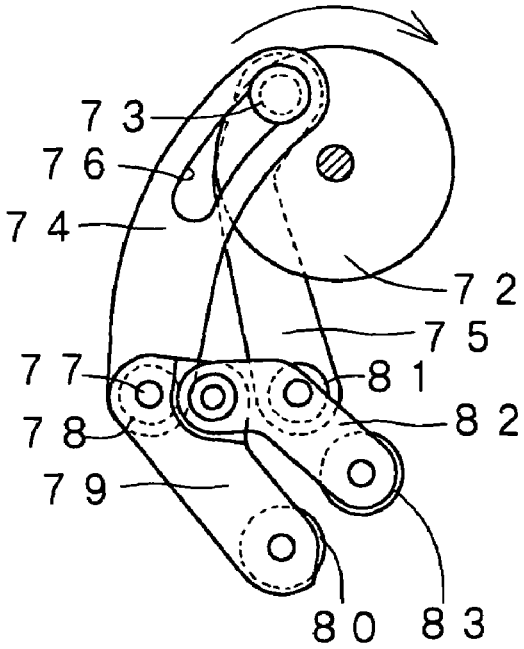
FIG. 16B is a fragmentary side view showing the state of the holding member in FIG. 16A.
Figure 17A:
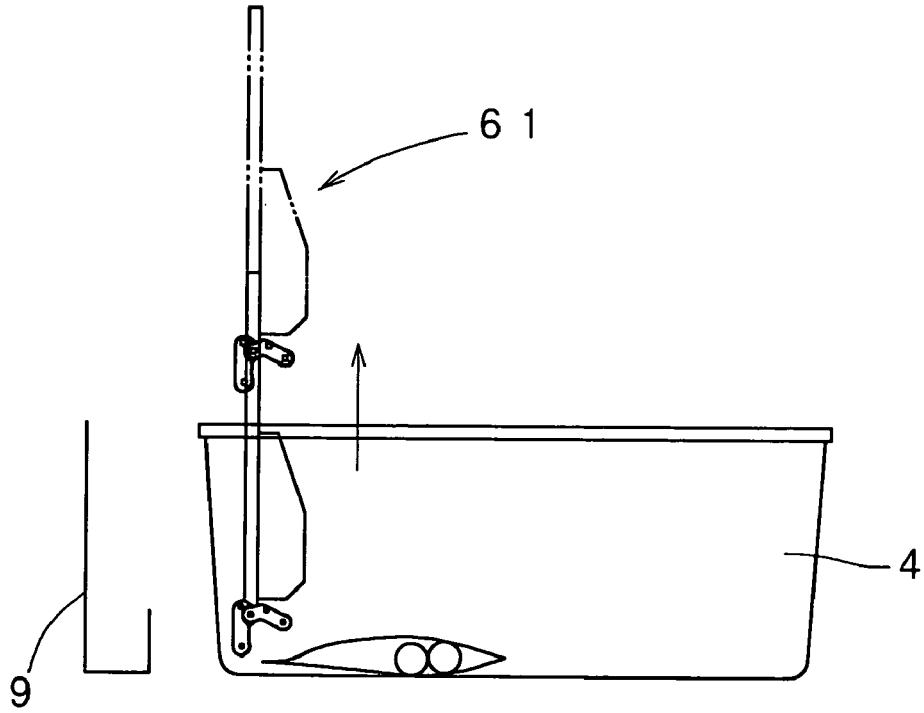
FIG. 17A is a front view showing the feeding state of the medicine envelope by the holding member of FIG. 13.
Figure 17B:
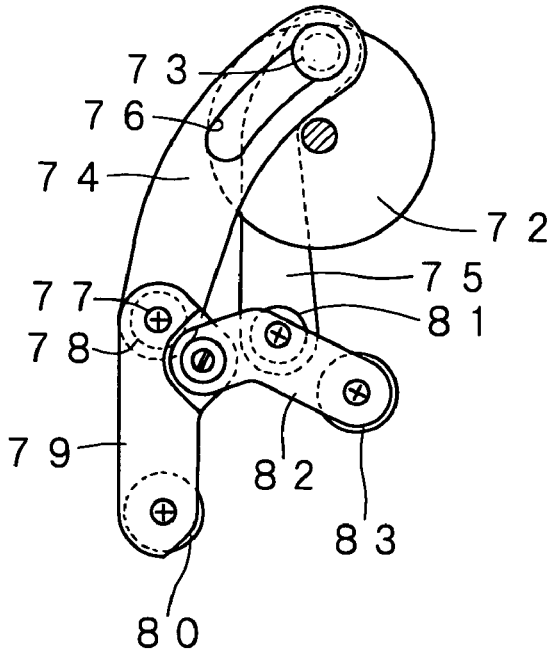
FIG. 17B is a fragmentary side view showing the state of the holding member in FIG. 17A.

After that, the motor 65 is driven to further rotate the drive disk 72 clockwise. Consequently, as shown in FIG. 16, not only the second arm 75 but also the first arm 74 move upward and relative positions of the one-way clutch 78 of the first nip arm 79 and the spindle 82*a* of the second nip arm 82 are changed, so that eventually the first nip roller 80 relatively moves away from the second nip roller 83, resulting in release of the medicine envelope as shown in FIG. 16A.

Thus, with the holding member 61, it becomes possible to implement a natural operation such as holding the medicine envelope manually and accommodating it in the bucket 4, and to securely prevent the opening part of the medicine envelope from opening and the inside injection medication containers from leaking.

The invention claimed is:

1. A medicine envelope feeder comprising:

a support member for supporting one face of a medicine envelope storing injection medicine containers so that an upper end portion of the medicine envelope can be bent over an upper end of the support member;

a vertically movable holding member comprising a guide part for guiding an opposite face of the medicine envelope, and a pressing part which is vertically movable along the guide part and can be lowered for pressing the folded upper end of the medicine envelope against the support member, wherein at least a coefficient of friction of the pressing part is larger than that of the support member, so that only the medicine envelope can be raised while being held between the guide part and the pressing part when the holding member is raised.

2. The medicine envelope feeder as defined in claim 1, wherein a part of the support member held between the guide part and the pressing part of the holding member is a rotating piece that is rotatable about one end portion thereof.

3. The medicine envelope feeder as defined in claim 2, wherein the support member is mounted so as to be pivotable about a lower end part thereof, and the support member comprises medicine envelope detection means for detecting that the medicine envelope has been fed, drive means for driving the support member upon the medicine envelope detection means detecting the medicine envelope, and rotating position detecting means for detecting that the support member is rotated in a state where the medicine envelope is held between the support member and the guide part of the holding member.

4. The medicine envelope feeder as defined in claim 2, wherein the holding member is capable of moving in a horizontal direction, and comprises a rotatable contact piece that is brought into contact with one surface of the medicine envelope as the holding member moves in the horizontal direction when the held medicine envelope is fed to a bucket.

5. The medicine envelope feeder as defined in claim 2, wherein a lower end portion of the guide part of the holding member comprises an inclined face that is gradually inclined away from the pressing part toward a lower end of the guide part so that, by moving the pressing part along the inclined face of the guide part, the held medicine envelope can be inclined with a folded side facing down.

6. The medicine envelope feeder as defined in claim 1, wherein the support member is mounted so as to be pivotable about a lower end part thereof, and the support member comprises medicine envelope detection means for detecting that the medicine envelope has been fed, drive means for driving the support member upon the medicine envelope detection means detecting the medicine envelope, and rotating position detecting means for detecting that the support member is rotated in a state where the medicine envelope is held between the support member and the guide part of the holding member.

7. The medicine envelope feeder as defined in claim 6, wherein the holding member is capable of moving in a horizontal direction, and comprises a rotatable contact piece that is brought into contact with one surface of the medicine envelope as the holding member moves in the horizontal direction when the held medicine envelope is fed to a bucket.

8. The medicine envelope feeder as defined in claim 6, wherein a lower end portion of the guide part of the holding member comprises an inclined face that is gradually inclined away from the pressing part toward a lower end of the guide part so that, by moving the pressing part along the inclined face of the guide part, the held medicine envelope can be inclined with a folded side facing down.

9. The medicine envelope feeder as defined in claim 1, wherein the holding member is capable of moving in a horizontal direction, and comprises a rotatable contact piece which is brought into contact with one surface of the medicine envelope as the holding member moves in the horizontal direction when the held medicine envelope is fed to a bucket.

10. The medicine envelope feeder as defined in claim 9, wherein the holding member further comprises an elastic pressing piece for pressing an upper folded side of the medicine envelope after retaining the medicine envelope on a bottom surface of the bucket with the contact piece.

11. The medicine envelope feeder as defined in claim 9, wherein a lower end portion of the guide part of the holding member comprises an inclined face that is gradually inclined away from the pressing part toward a lower end of the guide part so that, by moving the pressing part along the inclined face of the guide part, the held medicine envelope can be inclined with a folded side facing down.

12. The medicine envelope feeder as defined in claim 1, wherein a lower end portion of the guide part of the holding member comprises an inclined face which is inclined away from the pressing part toward a lower side of the holding member so that the held medicine envelope can be inclined with a folded side facing down by moving the pressing part along the inclined face of the guide part.

13. The medicine envelope feeder as defined in claim 1, wherein the support member is movable between an inclined envelope reception position and a vertical envelope delivery position.

14. A medicine envelope feeder comprising:

a support member for supporting one face of a medicine envelope storing injection medicine containers such that a portion of the medicine envelope from an upper end opening part of the medicine envelope can be bent over an upper end of the support member;

a vertically movable holding member including a pair of nip arms that are supported in a rotatable manner and have nip rollers at respective ends thereof for bending the medicine envelope with one of the nip rollers as the holding member is moved in a horizontal direction and for holding the medicine envelope in a twofold state by lowering the nip rollers so that the nip rollers are positioned on both sides of the support member, wherein at least a coefficient of friction of the nip rollers is larger than that of the support member, so that only the medicine envelope can be raised while being held between the nip rollers when the holding member is raised.

15. The medicine envelope feeder as defined in claim 14, wherein a rotating angle of the nip arms in the holding member can be changed according to conditions of the medicine envelope.

16. The medicine envelope feeder as defined in claim 14, wherein the support member is movable between an inclined envelope reception position and a vertical envelope delivery position.

* * * * *